US011095986B1

(12) United States Patent
Kim

(10) Patent No.: US 11,095,986 B1
(45) Date of Patent: Aug. 17, 2021

(54) VIBRATION SPEAKER FOR VEHICLE AND CONTROL METHOD THEREOF

(71) Applicants: Hyundai Motor Company, Seoul (KR); Kia Motors Corporation, Seoul (KR)

(72) Inventor: Youngbeom Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/028,113

(22) Filed: Sep. 22, 2020

(30) Foreign Application Priority Data

Feb. 19, 2020 (KR) ..... 10-2020-0020065

(51) Int. Cl.
*H04R 9/04* (2006.01)
*H04R 9/02* (2006.01)
*H04R 9/18* (2006.01)

(52) U.S. Cl.
CPC ..... *H04R 9/046* (2013.01); *H04R 9/025* (2013.01); *H04R 9/18* (2013.01)

(58) Field of Classification Search
CPC ..... H04R 9/046; H04R 9/025; H04R 9/18
USPC ..... 381/400
See application file for complete search history.

(56) References Cited

U.S. PATENT DOCUMENTS 7,190,796 B1 * 3/2007 Kashani ..... H03G 3/32 381/71.1
2004/0013283 A1 * 1/2004 Coffin ..... H04R 9/045 381/418
2009/0208039 A1 * 8/2009 Suzuki ..... H01L 41/12 381/190
2012/0045070 A1 * 2/2012 Mizuno ..... G10K 11/17854 381/66

FOREIGN PATENT DOCUMENTS

KR 10-0381440 B1 4/2003
KR 10-0687208 B1 2/2007

* cited by examiner

*Primary Examiner* — Sean H Nguyen
(74) *Attorney, Agent, or Firm* — Mintz Levin Cohn Ferris Glovsky and Popeo, P.C.; Peter F. Corless

(57) ABSTRACT

A vibration speaker includes: a housing; a diaphragm covering an open side of the housing and having a rim fixed to the housing; a vibration member installed in the housing to vibrate in a vibration direction of the diaphragm and having a magnet forming a magnetic field; a voice coil installed on an inner surface of the diaphragm and configured to vibrate the diaphragm through interaction with the vibration member; a solenoid driver fixed in the housing and configured to form the magnetic field that controls vibration of the vibration member; an amplifier configured to apply a first output signal to the voice coil and apply a second output signal having a phase different from the first output signal to the solenoid driver; and a controller configured to determine whether to apply the second output signal by comparing a frequency of the first output signal with the resonance frequency.

11 Claims, 3 Drawing Sheets

VIBRATION SPEAKER FOR VEHICLE AND CONTROL METHOD THEREOF

CROSS-REFERENCE TO RELATED APPLICATION

This application claims under 35 U.S.C. § 119 the benefit of Korean Patent Application No. 10-2020-0020065, filed on Feb. 19, 2020 in the Korean Intellectual Property Office, the entire contents of which are incorporated herein by reference.

BACKGROUND

1. Technical Field

The disclosure relates to a vibration speaker for a vehicle capable of improving bass output and a control method thereof.

2. Description of the Related Art

Electric vehicles powered by electric motors (EV), plug-in hybrid vehicles (PHEV), and hybrid vehicles (HEV) are at risk of pedestrian collision because only a minimal amount of noise may be emitted when driving. Therefore, these vehicles may apply a Virtual Engine Sound System (VESS) for generating engine noise with a vibration speaker, in order to reduce the occurrence of pedestrian collisions.

A vibration speaker used in the virtual engine sound system typically includes a case, a diaphragm provided on a part of the case, a voice coil coupled to the diaphragm, and a vibration member equipped with a magnet that operates a voice coil in a vibrating state in the case. This vibration speaker may have excellent durability, small size, and low price.

However, existing vibration speakers have a disadvantage in that the bass output is lower than that of a conventional speaker. The vibration speaker may have a high spring constant of the diaphragm, so the resonance frequency is high, and thus the bass output is low. Since the vibration speaker vibrates so that the diaphragm and the vibration member have a phase difference of almost 180° in a region above the resonance frequency, the magnetic flux linkage of the voice coil and the vibration member is lowered, resulting in lower output. In particular, in the bass region where displacement of vibration is large, the sound output is deteriorated.

SUMMARY

Therefore, it is an aspect of the present disclosure to provide a vibration speaker for a vehicle capable of improving bass output and a control method thereof.

In accordance with one aspect of the disclosure, a vibration speaker includes: a housing; a diaphragm covering an open side of the housing and having a rim fixed to the housing; a vibration member installed in the housing to vibrate in a vibration direction of the diaphragm and having a magnet forming a magnetic field; a voice coil installed on an inner surface of the diaphragm and configured to vibrate the diaphragm through interaction with the vibration member; a solenoid driver fixed in the housing and configured to form the magnetic field that controls vibration of the vibration member; an amplifier configured to apply a first output signal to the voice coil and apply a second output signal having a phase different from the first output signal to the solenoid driver; and a controller configured to determine whether to apply the second output signal by comparing the frequency of the first output signal with the resonance frequency.

The vibration speaker may further include: a position sensor installed in the housing and configured to detect a position of the vibration member through distance sensing.

The vibration speaker may further include: a magnetic shield surrounding an outside of a remainder of the solenoid driver except for a region facing the vibration member.

The controller may be configured to control the amplifier to apply the second output signal when the frequency of the first output signal is greater than or equal to the resonance frequency, and block the second output signal when the frequency of the first output signal is less than the resonance frequency.

The controller may be configured to control the amplifier to apply the second output signal with a phase difference of 180° relative to the first output signal when the frequency of the first output signal is higher than the resonance frequency.

The controller may be configured to control the amplifier to apply the second output signal with a phase difference of 90° relative to the first output signal when the frequency of the first output signal is equal to the resonance frequency.

The controller may be configured to control the amplifier to maintain an intensity of the second output signal when a distance between the position sensor and the vibration member is within a set distance range, reduce the intensity of the second output signal when the distance between the position sensor and the vibration member is greater than the set distance range and increase the intensity of the second output signal when the distance between the position sensor and the vibration member is less than the set distance range.

In accordance with another aspect of the disclosure, a control method of a vibration speaker includes: providing the vibration speaker; and controlling to apply the second output signal with a phase difference of 180° relative to the first output signal when the frequency of the first output signal is higher than the resonance frequency.

In accordance with another aspect of the disclosure, a control method of a vibration speaker includes: providing the vibration speaker; and controlling to apply the second output signal with a phase difference of 90° relative to the first output signal when the frequency of the first output signal is equal to the resonance frequency.

In accordance with another aspect of the disclosure, the control method of the vibration speaker includes: providing a position sensor installed in the housing and configured to detect a position of the vibration member through distance sensing; maintaining an intensity of a second output signal when a distance between the position sensor and the vibration member is within a set distance range; reducing the intensity of the second output signal when the distance between the position sensor and the vibration member is greater than the set distance range; and increasing the intensity of the second output signal when the distance between the position sensor and the vibration member is less than the set distance range.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
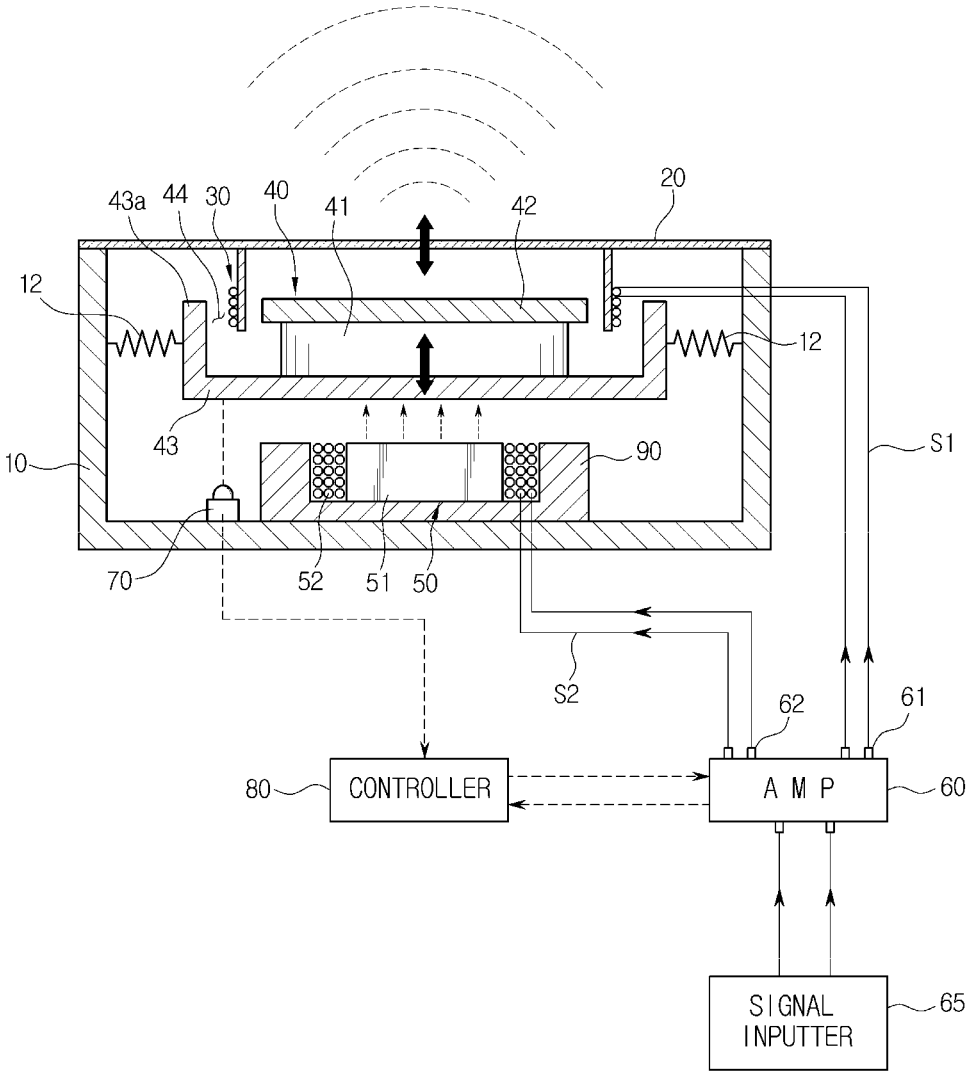
FIG. 1 illustrates the configuration of a vibration speaker according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, embodiments of the present disclosure will be described in detail with reference to the accompanying drawings. The following embodiments are presented to sufficiently convey the idea of present disclosure to a person having ordinary knowledge in the technical field to which the present disclosure belongs, and are not limited to those presented herein and may be embodied in other forms. To clarify the present disclosure, the drawings may omit the parts of the description that are not related to the description, and the size of the components may be exaggerated to facilitate understanding.

Referring to FIG. 1, a vibration speaker according to an embodiment of the present disclosure includes a housing 10, a diaphragm 20, a voice coil 30, a vibration member 40, a solenoid driver 50, an amplifier 60, a position sensor 70, and a controller 80.

The housing 10 may be provided in a substantially cylindrical shape, and has a space for accommodating a vibration member 40, a solenoid driver 50 therein. The housing 10 may have a shape in which one surface to which the diaphragm 20 is coupled is opened and the opposite side is closed.

The diaphragm 20 may have a rim fixed to the open side end of the housing 10 so as to cover one open surface of the housing 10. The diaphragm 20 may be provided as a thin plate, and may generate sound by vibration.

The voice coil 30 is installed on an inner surface of the diaphragm 20 and may vibrate the diaphragm 20 through interaction with the vibration member 40. The voice coil 30 may be in the form of a coil wound on the outer surface of the cylindrical bobbin, where one end is attached to the inner surface of the diaphragm 20. A high frequency AC current in the audible frequency band is applied to the voice coil 30.

The vibration member 40 is supported by a plurality of elastic members 12 connecting the outer side of the vibration member 40 and an inner surface of the housing 10, so that the vibration in a vibration direction of the diaphragm 20 in the housing 10 is possible. Here, the elastic member 12 illustrates a form connected to the outside of the vibration member 40, but the installation position of the elastic member 12 may be changed.

The vibration member 40 includes a magnet 41, a first yoke 42 coupled to one end of the magnet 41 facing the diaphragm 20 and provided in a disc shape capable of entering the inner space of the voice coil 30, a second yoke 43 coupled to the other end of the magnet 41 opposite the first yoke 42. The second yoke 43 has a diameter larger than the outer diameter of the voice coil 30 and has a cylindrical extension 43*a* extending to surround the outside of the voice coil 30 from the rim.

Figure 2:
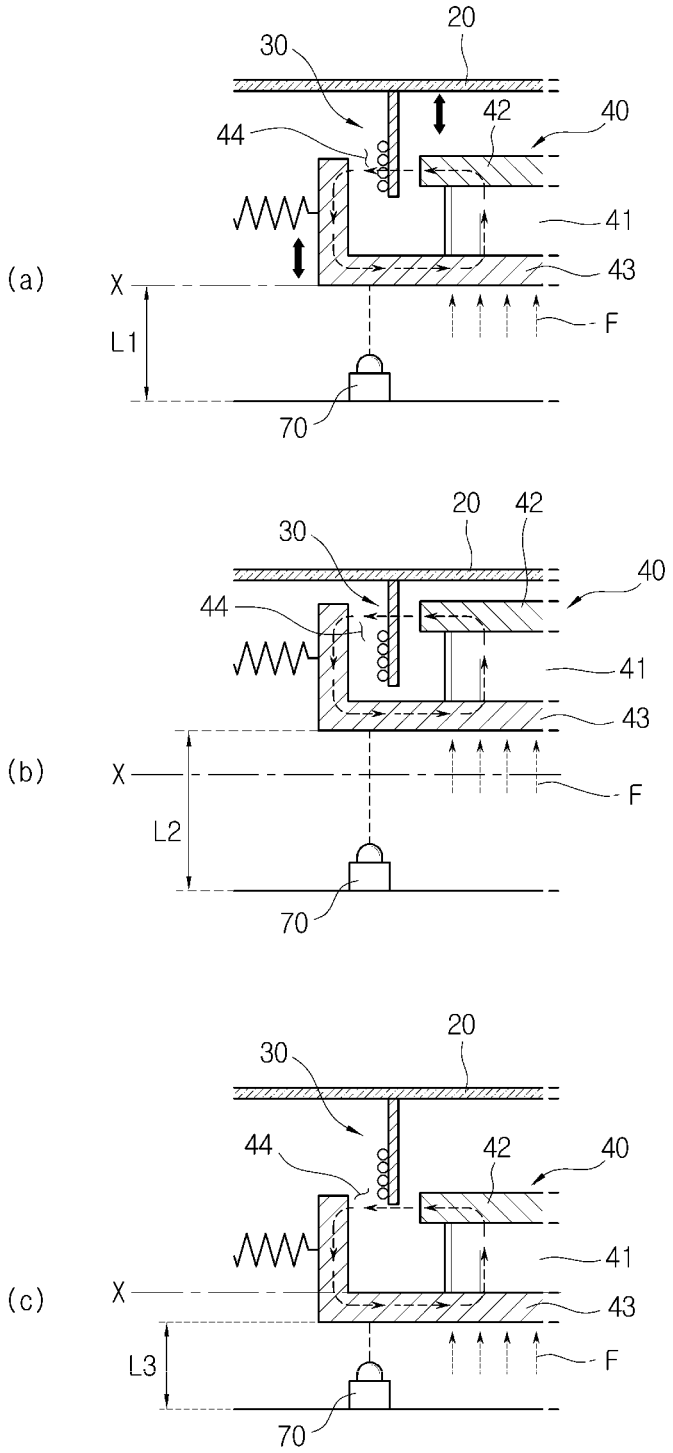
FIG. 2 illustrates the operation of the vibration member when the vibration speaker according to an embodiment of the present disclosure operates.

Referring to (a) of FIG. 2, the voice coil 30 is located in a state spaced apart in a gap 44 between the first yoke 42 and the second yoke 43 of the vibration member 40, and in the magnet 41, the N pole and the S pole are polarized toward the first yoke 42 side and the second yoke 43 side to form a magnetic field passing through the voice coil 30. Therefore, when an output signal (current signal) is applied to the voice coil 30, the diaphragm 20 vibrates, sound is output, and the vibration member 40 may also vibrate.

The solenoid driver 50 is fixed to the inner surface of the housing 10 facing the second yoke 43 of the vibration member 40, as shown in FIG. 1. The solenoid driver 50 may coincide with a line whose center passes through the center of the vibration member 40. The solenoid driver 50 includes a central iron core 51 and a coil 52 wound around the iron core 51.

The solenoid driver 50 forms the magnetic field that controls the vibration of the vibration member 40 by the input current signal. The magnetic field of the solenoid driver 50 may change the magnetic field affecting the vibration member 40 through changing a phase of the input current signal and an intensity of the current signal. Through this, the vibration of the vibration member 40 may be controlled.

The amplifier 60 includes a first signal outputter 61 for applying a first output signal S1 to the voice coil 30, and a second signal outputter 62 for applying a second output signal S2 to the solenoid driver 50. The amplifier 60 may vibrate the diaphragm 20 by applying a first output signal S1 to the voice coil 30 when an input signal is applied from the signal inputter 65. The amplifier 60 may adjust vibration of the vibration member 40 by forming the magnetic field in the solenoid driver 50 by applying the second output signal S2 of a phase different from the first output signal S1 to the solenoid driver 50 as required.

The controller 80 may control the amplifier 60 to apply or block the second output signal S2 according to the state of the first output signal S1. When the frequency of the first output signal S1 is greater than or equal to the resonance frequency of the vibration speaker, the controller 80 applies the second output signal S2 to the solenoid driver 50. The controller 80 may control the amplifier 60 to block the second output signal S2 when the frequency of the first output signal S1 is less than the resonance frequency.

In a typical vibration speaker, when the frequency of the first output signal S1 is less than the resonance frequency, there is almost no vibration phase difference between the diaphragm 20 and the vibration member 40, and when the frequency of the first output signal S1 is equal to the resonance frequency, the diaphragm 20 and the vibration member 40 vibrate to have a phase difference of 90°. In addition, when the frequency of the first output signal S1 exceeds the resonance frequency, the diaphragm 20 and the vibration member 40 vibrate to have a phase difference of almost 180°. Therefore, in the normal vibration speaker, when the first output signal S1 applied to the voice coil 30 is greater than or equal to the resonance frequency, since the phase difference between the diaphragm 20 and the vibration member 40 is too large and the magnetic flux linkage of the voice coil 30 and the vibration member 40 is lowered, the sound output may be lowered. This phenomenon may be exacerbated in the bass region where the vibration displacement is large.

However, in the vibration speaker of this embodiment, when the first output signal S1 is greater than or equal to the resonance frequency, the solenoid driver 50 may adjust the vibration of the vibration member 40 to reduce the phase difference between the diaphragm 20 and the vibration member 40. Therefore, it is possible to prevent the sound output from being deteriorated in the low-pitched region. That is, the bass output may be improved.

When the frequency of the first output signal S1 is higher than the resonance frequency, the controller 80 may reduce the vibration phase difference between the diaphragm 20 and the vibration member 40 by applying the second output signal S2 having a phase difference of 180° relative to the first output signal S1. In addition, when the frequency of the first output signal S1 is equal to the resonance frequency, the controller 80 may reduce the vibration phase difference between the diaphragm 20 and the vibration member 40 by applying the second output signal S2 having a phase difference of 90° relative to the first output signal S1. The controller 80 may control to block the second output signal S2 when the frequency of the first output signal S1 is less than the resonance frequency.

Referring to FIG. 1, the vibration speaker may include a magnetic shield 90 surrounding the outside of the rest of the solenoid driver 50 except for the region facing the vibration member 40.

The magnetic shield 90 is made of a non-magnetic material, and may be in the form of a cup that surrounds the circumference and bottom of the solenoid driver 50. The magnetic shield 90 minimizes leakage of the magnetic field generated by the solenoid driver 50 to the surroundings, thereby increasing the effect of the solenoid driver 50 controlling vibration of the vibration member 40. In this embodiment, the cup-shaped magnetic shield 90 is presented, but is not limited thereto, and the shape of the magnetic shield 90 may be variously changed.

As shown in FIG. 1, the vibration speaker may include a position sensor 70 that senses the position of the vibration member 40 through distance measurement. The position sensor 70 is fixed to the inner surface of the housing 10 and may measure the behavior of the vibration member 40 through sensing the separation distance when the vibration member 40 vibrates.

As shown in (a) of FIG. 2, when the position where the magnetic flux flows from the first yoke 42 of the vibration member 40 to the second yoke 43 coincides with the position of the voice coil 30, in the vibration speaker, the vibration of the diaphragm 20 increases as the magnetic flux interlinking the voice coil 30 becomes maximum, so that the sound output may be improved. That is, as shown in (a) of FIG. 2, when the magnetic field F intensity of the solenoid driver 50 is properly maintained so that the distance L1 between the position sensor 70 and the vibration member 40 maintains the set distance range (when the vibration member stays near the line "X" and vibrates), the vibration speaker may exhibit optimal efficiency.

However, as shown in (b) of FIG. 2, when the intensity of the magnetic field F of the solenoid driver 50 is too large, in the vibration speaker, the output may be deteriorated as the distance L2 between the position sensor 70 and the vibration member 40 is maintained larger than the set distance range and the magnetic flux path of the vibration member 40 and the position of the voice coil 30 are shifted. Also, as shown in (c) of FIG. 2, when the magnetic field F intensity of the solenoid driver 50 is too small, in the vibration speaker, the output may also be deteriorated as the distance L3 between the position sensor 70 and the vibration member 40 is maintained smaller than the set distance range and the magnetic flux path of the vibration member 40 and the position of the voice coil 30 are shifted.

Therefore, in the vibration speaker of this embodiment, the position of the vibration member 40 is always maintained in an optimal state as shown in the example shown in (a) of FIG. 2 by controlling an intensity of the second output signal S2 applied to the solenoid driver 50 by the controller 80 based on the detection information of the position sensor 70, so that the sound output may be prevented from deteriorating.

That is, the controller 80 may maintain the intensity of the second output signal S2 when the distance between the position sensor 70 and the vibration member 40 is within a set distance range, reduce the intensity of the second output signal S2 when the distance between the position sensor 70 and the vibration member 40 is greater than the set distance range and control the amplifier 60 to increase the intensity of the second output signal S2 when the distance between the position sensor 70 and the vibration member 40 is less than the set distance range.

Figure 3:
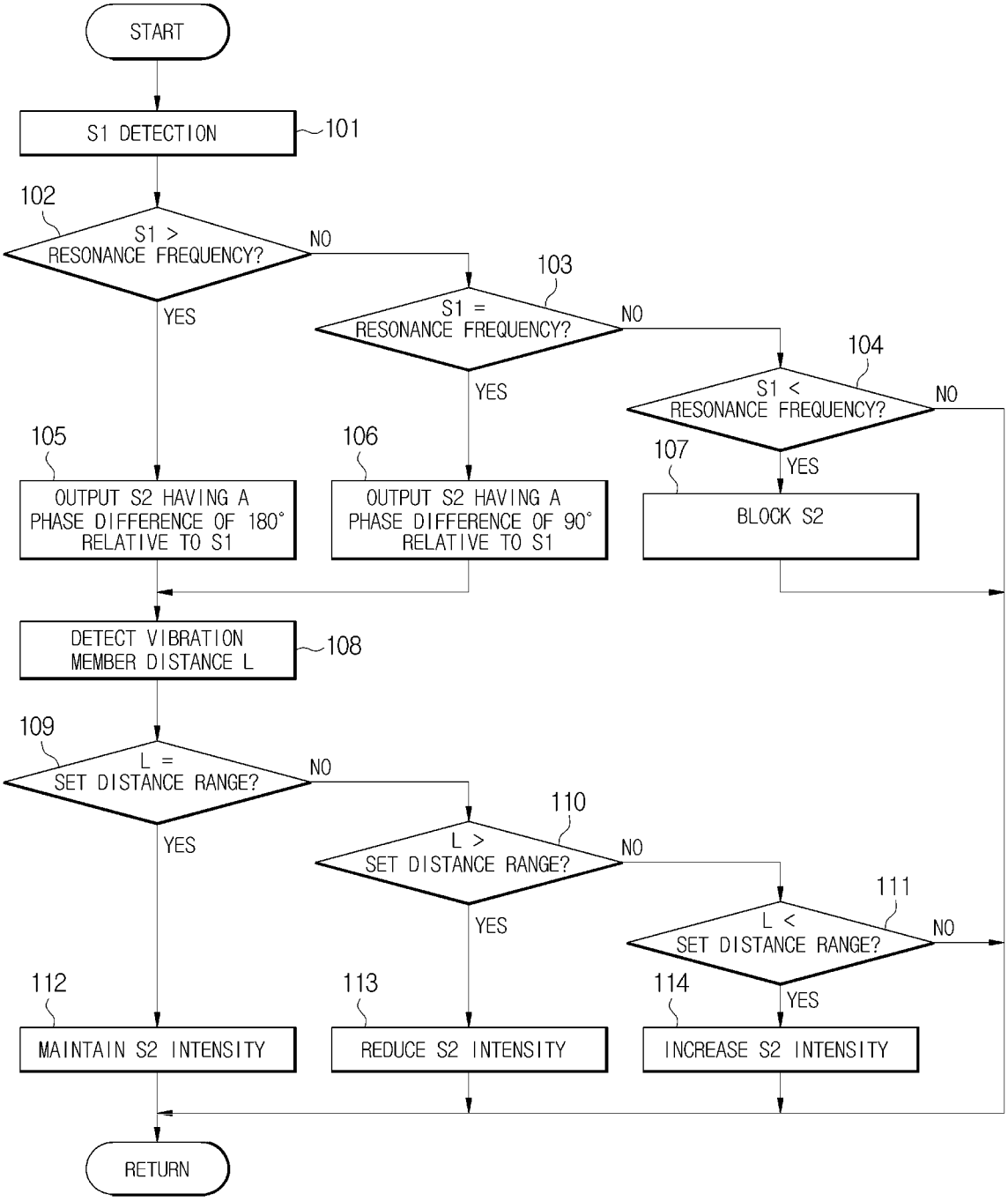
FIG. 3 is a flow chart illustrating a control method of a vibration speaker according to an embodiment of the present disclosure.

Next, a control method of a vibration speaker will be described with reference to the flowchart of FIG. 3.

The controller 80 detects the first output signal S1 output from the amplifier 60 (step 101), and determines whether the frequency of the first output signal S1 is higher than the resonance frequency (step 102).

When it is determined in step 102 that the frequency of the first output signal S1 is higher than the resonance frequency, the controller 80 controls the amplifier 60 to output the second output signal S2 having a phase difference of 180° relative to the first output signal S1 (step 105).

When it is determined in step 102 that the frequency of the first output signal S1 is not higher than the resonance frequency, the controller 80 determines whether the frequency of the first output signal S1 is equal to the resonance frequency (step 103). Here, when it is determined that the frequency of the first output signal S1 and the resonance frequency are the same, the controller 80 controls the amplifier 60 to output the second output signal S2 having a phase difference of 90° relative to the first output signal S1 (step 106).

When it is determined in step 103 that the frequency of the first output signal S1 is not equal to the resonance frequency, the controller 80 determines whether the frequency of the first output signal S1 is lower than the resonance frequency (step 104). Here, when it is determined that the frequency of the first output signal S1 is lower than the resonance frequency, the controller 80 controls the amplifier 60 to block the second output signal S2 (step 107), and performs step 101 again.

After steps 105 and 106, the controller 80 detects the distance L between the position sensor 70 and the vibration member 40 through the position sensor 70 (step 108), and determines whether the distance L of the position sensor 70 and the vibration member 40 is within a set distance range (step 109). In step 109, when the distance L between the position sensor 70 and the vibration member 40 is within a set distance range, the controller 80 controls the amplifier 60 to maintain the intensity of the second output signal S2 (step 112).

When it is determined in step 109 that the distance L between the position sensor 70 and the vibration member 40 is not within the set distance range, the controller 80 determines whether the distance L between the position sensor 70 and the vibration member 40 is greater than the set distance range (step 110).

When the distance L between the position sensor 70 and the vibration member 40 is greater than the set distance range in step 110, the controller 80 controls the amplifier 60 to reduce the intensity of the second output signal S2 (step 113). When it is determined in step 110 that the distance L between the position sensor 70 and the vibration member 40 is not greater than the set distance range, the controller 80 determines whether the distance L between the position sensor 70 and the vibration member 40 is smaller than the set distance range (step 111), and when the distance L between the position sensor 70 and the vibration member 40 is smaller than the set distance range, the controller 80 controls the amplifier 60 to increase the intensity of the second output signal S2 (step 114).

As described above, the vibration speaker according to the present embodiment controls the vibration of the vibration member 40 by controlling the second output signal S2 applied to the solenoid driver 50 according to whether the first output signal S1 is greater than or equal to the resonance frequency, and controls the intensity of the second output signal S2 applied to the solenoid driver 50 according to the position of the vibration member 40, so that the vibration member 40 can always stay in the optimal position, so it is possible to prevent the sound output from being lowered in the low-pitched region.

The vibration speaker according to the embodiment of the present disclosure can prevent the output of sound from being lowered in the bass region because the solenoid driver can adjust the vibration of the vibration member when the first output signal is above the resonance frequency. That is, the bass output can be improved.

The vibration speaker according to the present embodiment can prevent the output of sound from deteriorating in the low-pitched region because the vibration member can always stay in the optimal position by controlling the intensity of the second output signal applied to the solenoid driver according to the position of the vibration member.

Embodiment(s) of the disclosure have thus far been described with reference to the accompanying drawings. It should be obvious to a person of ordinary skill in the art that the disclosure may be practiced in other forms than the embodiment(s) as described above without changing the technical idea or essential features of the disclosure. The above embodiment(s) are only by way of example, and should not be interpreted in a limited sense.

What is claimed is:

1. A vibration speaker, comprising:

a housing;

a diaphragm covering an open side of the housing and having a rim fixed to the housing;

a vibration member installed in the housing to vibrate in a vibration direction of the diaphragm and having a magnet forming a magnetic field;

a voice coil installed on an inner surface of the diaphragm and configured to vibrate the diaphragm through interaction with the vibration member;

a solenoid driver fixed in the housing and configured to form the magnetic field that controls vibration of the vibration member;

an amplifier configured to apply a first output signal to the voice coil and apply a second output signal having a phase different from the first output signal to the solenoid driver; and a controller configured to determine whether to apply the second output signal by comparing a frequency of the first output signal with a resonance frequency.

2. The vibration speaker according to claim 1, further comprising:

a position sensor installed in the housing and configured to detect a position of the vibration member through distance sensing.

3. The vibration speaker according to claim 2, wherein the controller is configured to control the amplifier to maintain an intensity of the second output signal when a distance between the position sensor and the vibration member is within a set distance range, reduce the intensity of the second output signal when the distance between the position sensor and the vibration member is greater than the set distance range and increase the intensity of the second output signal when the distance between the position sensor and the vibration member is less than the set distance range.

4. The vibration speaker according to claim 1, further comprising:

a magnetic shield surrounding an outside of a remainder of the solenoid driver except for a region facing the vibration member.

5. The vibration speaker according to claim 1, wherein the controller is configured to control the amplifier to apply the second output signal when the frequency of the first output signal is greater than or equal to the resonance frequency, and block the second output signal when the frequency of the first output signal is less than the resonance frequency.

6. The vibration speaker according to claim 1, wherein the controller is configured to control the amplifier to apply the second output signal with a phase difference of 180° relative to the first output signal when the frequency of the first output signal is higher than the resonance frequency.

7. The vibration speaker according to claim 1, wherein the controller is configured to control the amplifier to apply the second output signal with a phase difference of 90° relative to the first output signal when the frequency of the first output signal is equal to the resonance frequency.

8. A control method of a vibration speaker, the control method comprising:

providing the vibration speaker, comprising:

a housing;

a diaphragm covering an open side of the housing and having a rim fixed to the housing;

a vibration member installed in the housing to vibrate in a vibration direction of the diaphragm and having a magnet forming a magnetic field;

a voice coil installed on an inner surface of the diaphragm and configured to vibrate the diaphragm through interaction with the vibration member;

a solenoid driver fixed in the housing and configured to form the magnetic field that controls vibration of the vibration member;

an amplifier configured to apply a first output signal to the voice coil and apply a second output signal having a phase different from the first output signal to the solenoid driver; and a controller configured to determine whether to apply the second output signal by comparing a frequency of the first output signal with a resonance frequency; and controlling to apply the second output signal with a phase difference of 180° relative to the first output signal when the frequency of the first output signal is higher than the resonance frequency.

9. The control method of claim 8, further comprising:

providing a position sensor installed in the housing and configured to detect a position of the vibration member through distance sensing;

maintaining an intensity of the second output signal when a distance between the position sensor and the vibration member is within a set distance range;

reducing the intensity of the second output signal when the distance between the position sensor and the vibration member is greater than the set distance range; and increasing the intensity of the second output signal when the distance between the position sensor and the vibration member is less than the set distance range.

10. A control method of a vibration speaker, the control method comprising:

providing the vibration speaker, comprising:

a housing;

a diaphragm covering an open side of the housing and having a rim fixed to the housing;

a vibration member installed in the housing to vibrate in a vibration direction of the diaphragm and having a magnet forming a magnetic field;

a voice coil installed on an inner surface of the diaphragm and configured to vibrate the diaphragm through interaction with the vibration member;

a solenoid driver fixed in the housing and configured to form the magnetic field that controls vibration of the vibration member;

an amplifier configured to apply a first output signal to the voice coil and apply a second output signal having a phase different from the first output signal to the solenoid driver; and a controller configured to determine whether to apply the second output signal by comparing a frequency of the first output signal with a resonance frequency; and controlling to apply the second output signal with a phase difference of 90° relative to the first output signal when the frequency of the first output signal is equal to the resonance frequency.

11. The control method of claim 10, further comprising:

providing a position sensor installed in the housing and configured to detect a position of the vibration member through distance sensing;

maintaining an intensity of the second output signal when a distance between the position sensor and the vibration member is within a set distance range;

reducing the intensity of the second output signal when the distance between the position sensor and the vibration member is greater than the set distance range; and increasing the intensity of the second output signal when the distance between the position sensor and the vibration member is less than the set distance range.

* * * * *